US006870556B2

(12) United States Patent
Chien et al.

(10) Patent No.: US 6,870,556 B2
(45) Date of Patent: Mar. 22, 2005

(54) THERMAL PRINTER AND METHOD FOR TRANSFERRING DYES ON MULTIPLE DYE BLOCKS ONTO MEDIA

(75) Inventors: Hsu-Chu Chien, Taipei (TW); Chih-Cheng Chang, Chi-Lung (TW)

(73) Assignee: Hi-Touch Imaging Technologies Co., Ltd., Pan-Chiao (TW)

( * ) Notice: Subject to any disclaimer, the term of this patent is extended or adjusted under 35 U.S.C. 154(b) by 21 days.

(21) Appl. No.: 10/604,586

(22) Filed: Jul. 31, 2003

(65) Prior Publication Data

US 2004/0227804 A1 Nov. 18, 2004

(30) Foreign Application Priority Data

May 15, 2003 (TW) ..... 92113216 A

(51) Int. Cl.[7] ..... B41J 2/525
(52) U.S. Cl. ..... 347/176; 400/120.04
(58) Field of Search ..... 347/172, 174, 347/176, 212, 224, 217; 400/120.02, 120, 240

(56) References Cited

U.S. PATENT DOCUMENTS 4,388,628 A * 6/1983 Moriguchi et al. ..... 347/175
4,505,603 A * 3/1985 Yana ..... 400/120.04
4,738,555 A * 4/1988 Nagashima ..... 400/240

FOREIGN PATENT DOCUMENTS

TW 283685 8/1996

* cited by examiner

*Primary Examiner*—Huan Tran
(74) *Attorney, Agent, or Firm*—Winston Hsu

(57) ABSTRACT

A method includes distributing grayscales of dye blocks in each of a plurality of color blocks to be printed as an image on a medium according to grayscales of the image to be printed on the medium and a predetermined printing rule, transferring the dyes of the dye blocks in the plurality of color blocks to the medium to generate the image according to the distribution, and transferring dyes of an overcoating block in the last color block of the plurality of color blocks to the medium.

12 Claims, 8 Drawing Sheets

THERMAL PRINTER AND METHOD FOR TRANSFERRING DYES ON MULTIPLE DYE BLOCKS ONTO MEDIA

BACKGROUND OF INVENTION

1. Field of the Invention

The present invention relates to a thermal printer and a related method, and more particularly, to a thermal printer and a related method for printing a plurality of color blocks to media for printing images.

2. Description of the Prior Art

Thermal transferring printing technology was first researched in the early 80s by Fujicopian Co., Ltd. Afterward, this proprietary technology was transferred to American research organizations to develop via International Imaging Materials, Inc. The first commercial thermal printer appeared in 1986. Thereafter, thermal transferring printing systems have undergone many improvements and revolutions. As the demand for polychrome imaging increases and the ratio of possession of digital cameras keeps increasing, not only businesses but the general public also need a way to print their polychrome photos. However, because of a thermal diffusion effect brought by heating a point, the resolution of most thermal transferring was not very good in the early stages.

The material of the transferring ribbon adapted by common thermal printers is a kind of transparent celluloid paper containing wax and dye. The thermal print head heats the dye of the transferring ribbon when printing. When the temperature increases, the dye liquefies temporarily and moves from the transferring ribbon to a medium (paper for example). Then the dye cools and solidifies on the medium to display an image. Please refer to FIG. 1. FIG. 1 is a diagram of a polychrome transferring ribbon of a conventional thermal transferring process. As illustrated in FIG. 1, there are consecutive color blocks 141 and 142 on a polychrome ribbon 12. There are dye blocks of different colors and an overcoating block in each color block. For example, there is a yellow dye block 1Y1, a magenta dye block 1M1, a cyan dye block 1C1, and an overcoating block 1O1 in color block 141. When a thermal printer of the prior art prints a polychrome image, the thermal printer head heats dye blocks of different colors and an overcoating block in a color block on a polychrome ribbon in turn, and transfers the dye and the overcoating to a medium. Taking the polychrome ribbon 12 and the color block 141 for example, the thermal print head heats and transfers the dyes of yellow dye block 1Y1, magenta dye block 1M1, and cyan dye block 1C1 in turn from a starting point 161, and then heats overcoating block 1O1 to cover the output image with the overcoating. The process of thermal transferring ends up at an end point 181. FIG. 2 is a cross-sectional diagram of a result of a conventional polychrome thermal transferring technology. M1 is a medium to display an output image. LY1, LM1, and LC1 are a yellow dye layer, a magenta dye layer, and a cyan dye layer, respectively. LO1 is an overcoating layer.

Please refer to FIG. 3. FIG. 3 is a diagram of a monochromatic transferring ribbon of a conventional thermal transferring process. As illustrated in FIG. 3, there are consecutive color blocks 341 and 342 on a monochromatic ribbon 32. Each color block contains a black dye block and an overcoating block. The color block 341 contains a black dye block 3K1 and an overcoating block 3O1. When a thermal printer of the prior art prints a monochromatic image, the thermal printer head heats a black dye block and an overcoating block in one color block in turn, and transfers the dye and the overcoating to a medium. Taking monochromatic ribbon 32 and color block 341 for example, the thermal print head heats and transfers the dye of black dye block 3K1 from a starting point 361, and then heats overcoating block 3O1 to cover the output image with the overcoating. The process of thermal transferring ends up at an end point 381. FIG. 4 is a cross-sectional diagram of a result of a conventional monochromatic thermal transferring technology. M3 is a medium to display an output image, LK3 is a black dye layer, and LO3 is an overcoating layer.

Since the thermal print head can control the heating time to determine the amount of dye to transfer, the color output of a thermal printer is more accurate than that of an ink jet printer or other type of printer, and the number of colors available are as many as to approach true color. The performance is more similar to photo quality than output of the ink jet printer. For instance, a printer capable of continuous color hues can display a smooth grayscale from white to black, but a printer only capable of discrete color hues, like an ink jet printer, can only emulate the true colors of an image by dithering, which cannot compete with the quality of continuous color hues. Regarding preservation, the protective overcoating layer output by the thermal printer provides advantages in waterproofing, UV-ray proofing, and fingerprint proofing over other technologies. Therefore, the overall performance of thermal printers is much better than that of other printers, even though the resolution of thermal transferring printers is not relatively high.

The principle of thermal transferring of the prior art is to heat dye on a transferring ribbon by a thermal print head, temporarily liquefy the dye and transfer it to a medium, and then solidify the dye to display an image. However, the material of the transferring ribbon (transparent celluloid paper usually) readily becomes deformed and rippled if it has been heated for too long. Therefore, if the grayscale or the saturation of colors of the output image is high, the thermal print head heats the transferring ribbon for a longer time and a ripple effect is generated on the medium. To avoid this kind of distortion, the thermal printer of the prior art limits the successive heating time so the thermal print head does not provide too much heat, and thus, is not able to print images with higher saturation and wider dynamic range of color.

In order to overcome this problem of insufficient saturation and dynamic range of color, improving the quality of transferring ribbons has been the focus of the prior art. However, further improvement is restricted since the ceiling of the technology has nearly been reached.

SUMMARY OF INVENTION

It is therefore a primary objective of the claimed invention to provide a thermal printer and a related method for transferring a plurality of color blocks to media to increase the saturation and to broaden dynamic range of colors of output images.

Briefly described, the claimed invention discloses a printing method for a thermal printer comprising distributing grayscales of dye blocks in each of a plurality of color blocks to be printed as an image on a medium according to grayscales of the colors of the image to be printed on the medium and a predetermined printing rule, transferring the dyes of the dye blocks in the plurality of color blocks to the medium to generate the image according to the distribution, and transferring dye of an overcoating block in a last color block of the plurality of color blocks to the medium.

The claimed invention further discloses a thermal printer comprising a thermal print head, a transferring ribbon comprising a plurality of color blocks, each of which comprises at least one dye block, and a logic unit. The logic unit is capable of distributing grayscales of dye blocks in each of a plurality of color blocks to be printed as an image on a medium according to grayscales of the image to be printed on the medium and a predetermined printing rule, controlling the print head to transfer the dyes of the dye blocks in the plurality of color blocks to the medium to generate the image according to the distribution, and controlling the print head to transfer dye of an overcoating block of a last color block of the plurality of color blocks to the medium. The logic unit is a logic circuit or a program code stored in a memory of the thermal printer. The thermal printer further comprises a control circuit capable of controlling operations of the thermal printer.

It is an advantage of the present invention that the thermal printer transfers dyes of a plurality of color blocks to media to display images In a way that increases the saturation and the dynamic range of colors of output images and avoids the ripple effect caused by heating the transferring ribbon for too long.

These and other objectives of the present invention will no doubt become obvious to those of ordinary skill in the art after reading the following detailed description of the preferred embodiments that are illustrated in the various figures and drawings.

DETAILED DESCRIPTION

Figure 1:
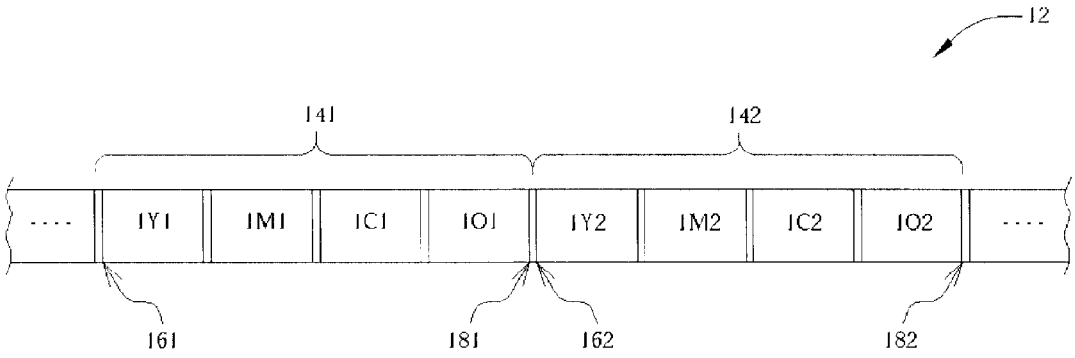
Fig. 1 Prior art
FIG. 1 is a diagram of a polychrome transferring ribbon of a conventional thermal transferring process.
Figure 2:
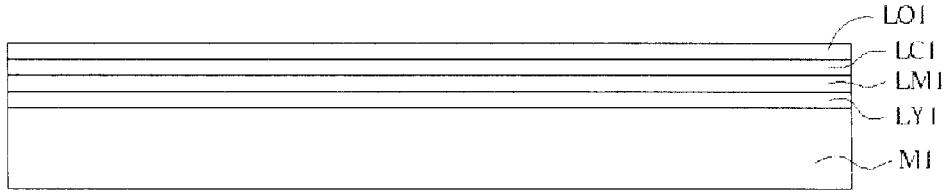
Fig. 2 Prior art
FIG. 2 is a cross-sectional diagram of a result of a conventional polychrome thermal transferring technology.
Figure 3:
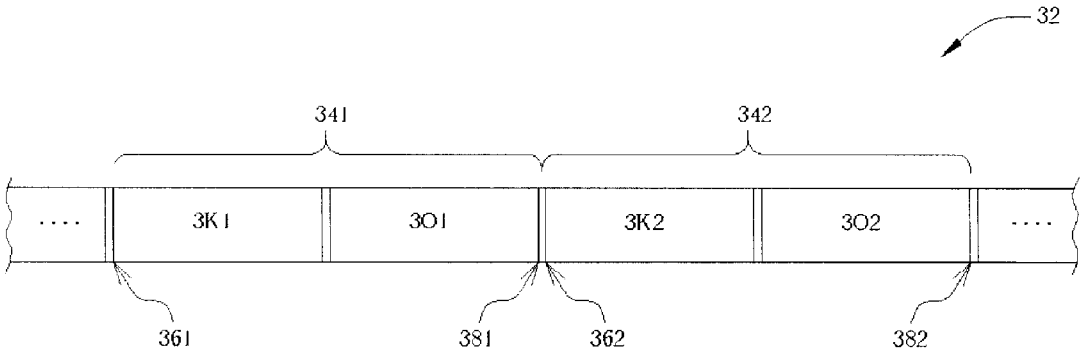
Fig. 3 Prior art
FIG. 3 is a diagram of a monochromatic transferring ribbon of a conventional thermal transferring process.
Figure 4:
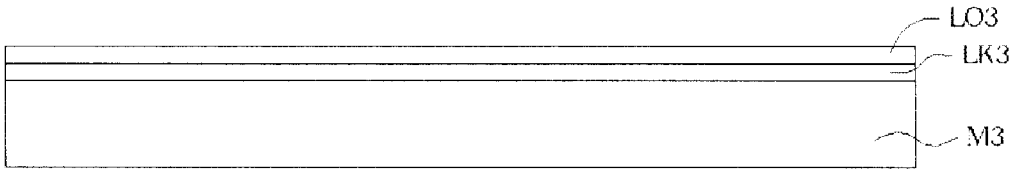
Fig. 4 Prior art
FIG. 4 is a cross-sectional diagram of a result of a conventional monochromatic thermal transferring technology.
Figure 5:
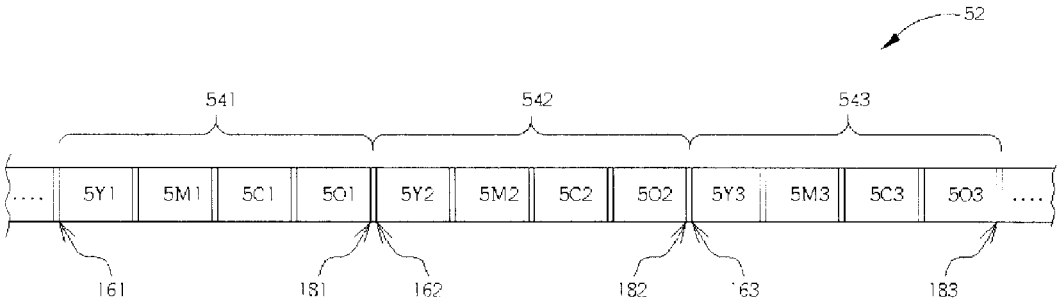
FIG. 5 is a diagram of a polychrome transferring ribbon of the present invention thermal transferring process.

Please refer to FIG. 5. FIG. 5 is a diagram of a polychrome transferring ribbon of the present invention thermal transferring process. In FIG. 5, there are consecutive color blocks 541, 542, and 543 on a polychrome ribbon 52. There are dye blocks of different colors in a color block. For example, there are a yellow dye block 5Y1, a magenta dye block 5M1, a cyan dye block 5C1, and an overcoating block 5O1 in the color block 541. In the present invention, a value of n and ratios of dyes of each color block to be transferred are decided first according to grayscales of an image to be output to a medium and a predetermined printing rule. When the thermal printer prints a polychrome image, the thermal print head heats dye blocks of different colors in n color blocks on the polychrome ribbon 52, and transfers the dyes to the medium. The dyes of the overcoating blocks of the first (n−1) color blocks are not transferred. Only the dye of the overcoating block of the last color block, that is, the n-th color block, is transferred to the medium to cover the output image. For instance, assuming the value of n is 2, and it is determined in the predetermined printing rule is: the whole color of the image to be printed is transferred when transferring dyes of the first color block, but when transferring dyes of the second color block, the part of the image to be printed of which the grayscale is less than 50% is not transferred, and for the part of which the grayscale is more than 50%, the grayscales are expanded to 0 to 100% for transfer. Therefore, a transferring process started at a starting point 561 is as follows. The thermal print head heats the polychrome ribbon 52 from the starting point 561 and transfers dyes of yellow dye block 5Y1, magenta dye block 5M1, and cyan dye block 5C1 in turn according to the grayscales of each color of the image to be output. The overcoating block 5O1 is passed and not transferred. Then, for the part of which the grayscales are more than 50%, the grayscales are expanded to 0 to 100%, and the thermal print head heats and transfers dyes of yellow dye block 5Y2, magenta dye block 5M2, and cyan dye block 5C2 according to the grayscales after expansion. Finally, the dye of overcoating block 5O2 is transferred to cover the output image. The transferring process stops at an end point 582.

Figure 6:
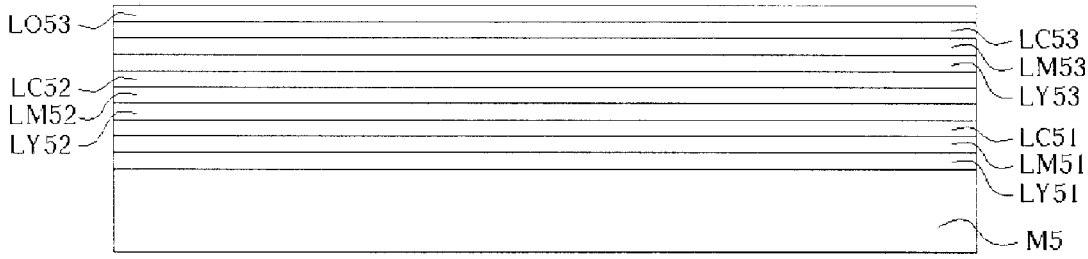
FIG. 6 is a cross-sectional diagram of a result of the present invention polychrome thermal transferring process.

Taking another example, assuming n is 3 in the predetermined printing rule, and it is determined that: 50% of the original colors of the image to be output is transferred when transferring the first color block, 35% of the original colors of the image to be output is transferred when transferring the second color block, and 15% of the original colors of the image to be output is transferred when transferring the third color block. Therefore, a transferring process started at a starting point 561 is as follows. The thermal print head heats from the starting point 561 and transfers dyes of yellow dye block 5Y1, magenta dye block 5M1, and cyan dye block 5C1 of 50% of the grayscales of each color of the image to be output in turn. The overcoating block 5O1 is passed and not transferred. Then the thermal print head heats and transfers dyes of yellow dye block 5Y2, magenta dye block 5M2, and cyan dye block 5C2 of 35% of the grayscales of each color of the image to be output in turn. The overcoating block 502 is passed and not transferred. After that, the thermal print head heats and transfers dyes of yellow dye block 5Y3, magenta dye block 5M3, and cyan dye block 5C3 at 15% of the grayscales of each color of the image to be output in turn. Finally, the dye of overcoating block 503 is transferred to cover the output image. The transferring process stops at an end point 583. FIG. 6 is a cross-sectional diagram of a result of the present invention polychrome thermal transferring process. M5 is a medium. LY51, LY52, and LY53 are yellow dye layers. LM51, LM52, and LM53 are magenta dye layers. LC51, LC52, and LC53 are cyan dye layers. And, LO53 is an overcoating layer.

Figure 7:
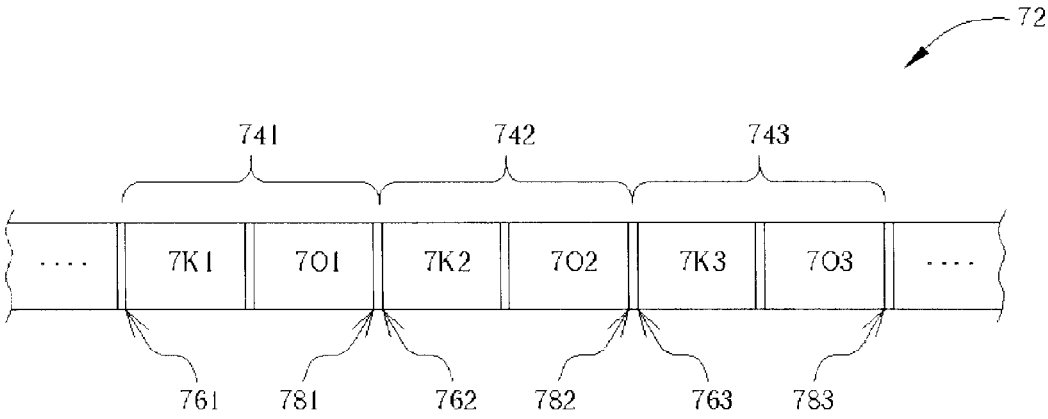
FIG. 7 is a diagram of a monochromatic transferring ribbon of the present invention thermal transferring process.

Please refer to FIG. 7. FIG. 7 is a diagram of a monochromatic transferring ribbon of the present invention thermal transferring process. As shown in FIG. 7, consecutive color blocks 741, 742, and 743 are disposed on a monochromatic ribbon 72. There are a black dye block and an overcoating block in each color block. For instance, there are a black dye block 7K1 and an overcoating block 7O1 in a color block 741. In the present invention, a value of n and ratios of dyes of each color block to be transferred are decided first according to grayscales of an image to be output to a medium and a predetermined printing rule. When the thermal printer prints a monochromatic image, the thermal print head heats black dye blocks in n color blocks on the monochromatic ribbon 72, and transfers the dyes to the medium. The dyes of the overcoating blocks in the first (n−1) color blocks are not transferred. Only the dye of the overcoating block in the last color block, that is, the n-th color block, is transferred to the medium to cover the output image. For instance, assuming the value of n is 2, and it is determined in the predetermined printing rule that when transferring dyes of the first color block, the whole color of the image to be printed is transferred, but when transferring dyes of the second color block, the part of the image to be printed of which the grayscale is less than 50% is not transferred, and for the part of which the grayscale is more than 50%, the grayscales are expanded to 0 to 100% for transfer. Therefore, a transferring process started at a starting point 761 is as follows. The thermal print head heats from the starting point 761 and transfers dye of black dye block 7K1 according to the grayscale of the image to be output. The overcoating block 7O1 is passed and not transferred. Then, for the part of which the grayscale is more than 50%, the grayscale is expanded to 0 to 100%, and the thermal print head heats and transfers dye of black dye block 7K2 according to the grayscale after expansion. Finally, the dye of overcoating block 7O2 is transferred to the medium to cover the output image. The transferring process stops at an end point 782.

Figure 8:
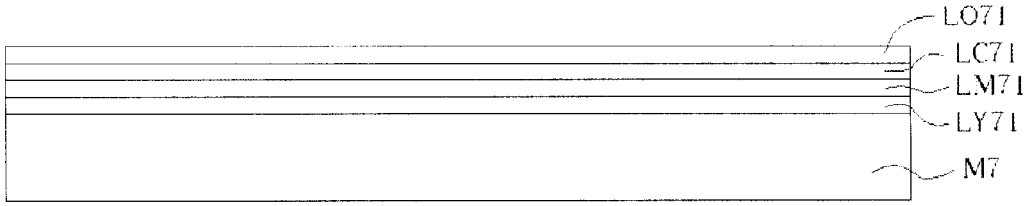
FIG. 8 is a cross-sectional diagram of a result of the present invention monochromatic thermal transferring process.

Taking another example, assuming n is 3 in the predetermined printing rule, and it is determined that: 50% of the original color of the image to be output is transferred when transferring the first color block, 35% of the original color of the image to be output is transferred when transferring the second color block, and 15% of the original color of the image to be output is transferred when transferring the third color block. Therefore, a transferring process started at a starting point 761 is as follows. The thermal print head heats from the starting point 761 and transfers the dye of black dye block 7K1 of 50% of the grayscale of the image to be output. The overcoating block 7O1 is passed and not transferred. Then the thermal print head heats and transfers dye of black dye block 7K2 of the grayscale of the image to be output. The overcoating block 7O2 is passed and not transferred. After that, the thermal print head heats and transfers dyes of black dye block 7K3 of 15% of the grayscale of the image to be output. Finally, the dye of overcoating block 7O3 is transferred to cover the output image. The transferring process stops at an end point 783. FIG. 8 is a cross-sectional diagram of a result of the present invention monochromatic thermal transferring process. M7 is a medium. LK71, LK72 and LK73 are black dye layers. LO73 is an overcoating layer.

The present invention provides a thermal printer and a related method for transferring a plurality of dye layers of the same color in order to increase the saturation and the dynamic range of colors of an output image. The present invention also avoids the distortion caused by the ripple effect because it heats the transferring ribbon for a relatively short time.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A method for a thermal printer, the method comprising:

(a) distributing grayscales of dye blocks in each of a plurality of color blocks to be printed as an image on a medium according to grayscales of the image to be printed on the medium and a predetermined printing rule;

(b) transferring the dyes of the dye blocks in the plurality of color blocks to the medium to generate the image according to the distribution in (a); and (c) transferring dyes of an overcoating block of a last color block of the plurality of color blocks to the medium;

wherein the thermal printer comprises a transferring ribbon comprising a plurality of color blocks, each of which comprising at least one dye block.

2. The method of claim 1, in which each color block of the transferring ribbon comprises a yellow dye block, a magenta dye block, and a cyan dye block.

3. The method of claim 1, in which each color block of the transferring ribbon comprises a black dye block.

4. The method of claim 1, in which only the color block utilized in step (c) of the transferring ribbon comprises an overcoating block.

5. The method of claim 1, in which each color block of the transferring ribbon comprises an overcoating block.

6. A thermal printer comprising:

a thermal print head;

a transferring ribbon comprising a plurality of color blocks, each of which comprises at least one dye block;

a logic unit capable of performing the following steps:

(a) distributing grayscales of dye blocks in each of a plurality of color blocks to be printed as an image on a medium according to grayscales of the image to be printed on the medium and a predetermined printing rule;

(b) controlling the print head to transfer the dyes of the dye blocks in the plurality of color blocks to the medium to generate the image according to the distribution in (a); and (c) controlling the print head to transfer dyes of an over-coating block of a last color block of the plurality of color blocks to the medium; and a control circuit capable of controlling operations of the thermal printer.

7. The thermal printer of claim 6, in which each color block of the transferring ribbon comprises a yellow dye block, a magenta dye block, and a cyan dye block.

8. The thermal printer of claim 6, in which each color block of the transferring ribbon comprises a black dye block.

9. The thermal printer of claim 6, in which only the color block utilized in step (c) of the transferring ribbon comprises an overcoating block.

10. The thermal printer of claim 6, in which each color block of the transferring ribbon comprises an overcoating block.

11. The thermal printer of claim 6, in which the logic unit is a logic circuit.

12. The thermal printer of claim 6, in which the logic unit is a program code stored in a memory of the thermal printer.

* * * * *